US007594775B1

(12) United States Patent
Yoo

(10) Patent No.: US 7,594,775 B1
(45) Date of Patent: Sep. 29, 2009

(54) CASE FOR COSMETICS

(75) Inventor: Kyung Hun Yoo, Seoul (KR)

(73) Assignee: Hwasung Cosemetics Co., Ltd., Gyeongi-Do (KR)

( * ) Notice: Subject to any disclaimer, the term of this patent is extended or adjusted under 35 U.S.C. 154(b) by 0 days.

(21) Appl. No.: 12/220,969

(22) Filed: Jul. 29, 2008

(30) Foreign Application Priority Data

Mar. 26, 2008 (KR) ..... 10-2008-0027727

(51) Int. Cl.
*A46B 17/04* (2006.01)
*A46B 11/04* (2006.01)

(52) U.S. Cl. ..... 401/269; 401/278; 401/279; 401/202; 401/205

(58) Field of Classification Search ..... 401/183–186, 401/202, 205, 206, 262, 263, 269, 270, 278, 401/279

See application file for complete search history.

(56) References Cited

U.S. PATENT DOCUMENTS 4,739,906 A * 4/1988 LoTurco ..... 222/212
7,281,876 B2 * 10/2007 Kwon ..... 401/265
7,384,208 B2 * 6/2008 Bouix et al. ..... 401/269
7,500,801 B2 * 3/2009 Chu et al. ..... 401/262

* cited by examiner

*Primary Examiner*—David J Walczak
(74) *Attorney, Agent, or Firm*—Jordan and Hamburg LLP

(57) ABSTRACT

A case for cosmetics, wherein, upon fastening up/down through rotation, an outer cap automatically opens/closes a dispensing hole of a cosmetic liquid dispenser to regulate a supply of cosmetic liquid to an applicator, thereby preventing unnecessary leakage of the cosmetic liquid and, even upon long-term use, preventing malfunction of the cosmetic liquid dispenser while simplifying the opening/closing structure of the dispensing hole thereof, and maximizing the reliability of use by ensuring the smooth supply of the cosmetic liquid.

7 Claims, 9 Drawing Sheets

CASE FOR COSMETICS

BACKGROUND OF THE INVENTION

1. Field of the Invention

The present invention relates, in general, to a case for cosmetics in which a cosmetic liquid dispenser and an applicator are coupled onto a tubular case body so that they are protected by an outer cap to be screwed thereto and, more particularly, to a case for cosmetics, wherein upon fastening up/down through rotation, an outer cap automatically opens/closes a dispensing hole of a cosmetic liquid dispenser to regulate a supply of cosmetic liquid to an applicator, thereby preventing unnecessary leakage of the cosmetic liquid and, even upon long-term use, preventing malfunction of the cosmetic liquid dispenser while simplifying an opening/closing structure of the dispensing hole thereof, and maximizing the reliability of use through smooth supply of the cosmetic liquid.

2. Description of the Related Art

Generally, sticky cosmetics, like cream, among liquefied cosmetics are contained in a tubular case body made from a soft material, and are used by squeezing them out of a cosmetic liquid dispenser, which is coupled to the case body, through forced pressing of the case body.

This makes it possible to use the cosmetic liquid without applying it to one's hands. For further enhancement of convenience, a separate cosmetic liquid dispenser is provided in front of the case body so as to dispense the cosmetic liquid toward an applicator coupled thereto, so that a user can apply the cosmetic to his/her face using the applicator.

Thus, such a case for liquefied cosmetics is used such that the makeup is carried out using the applicator which is to be applied with the cosmetic liquid via the cosmetic liquid dispenser by pressing the case body with the outer cap in an open state.

However, since the liquefied cosmetics have fluidity, even when not in use, the cosmetic liquid in the case body leaks outside through the cosmetic liquid dispenser, thereby being wasted. Further, in the case where no sealing function is provided, volatile components are volatilized so as to accelerate curing of the cosmetics, thus shortening the lifetime thereof.

Therefore, many technologies have been proposed for preventing unnecessary dispensing of the cosmetic liquid by opening the dispensing hole of the cosmetic liquid dispenser merely by detaching the outer cap.

Korean Utility Model Registration No. 20-436166 has, for example, disclosed a case for cosmetics in which a support coupled with a painting brush is resiliently supported by a lower resilient piece and a compressing spring on an inner cap coupled onto a case body, so that the support is resiliently moved upward to open a dispensing hole of the inner cap to supply the cosmetic liquid, depending upon opening/closing operations of an outer cap coupled onto the case body.

Here, the opening/closing of the dispensing hole below the support is carried out through the insertion/separation of an opening/closing valve into/from the dispensing hole.

However, such conventional technologies need a plurality of parts and are complicated to assemble, increasing the manufacturing cost.

In particular, since the support resiliently operates with the resilient piece and the compressing spring below the support, there is a problem in that a malfunction occurs in the opening/closing of the dispensing hole through weakened resilient movement of the support due to deterioration in performance of the resilient piece and the compressing spring for reasons of repetitive use and long-time use.

Further, there is a problem in that it is difficult to open/close due to the occurrence of deformation in the opening/closing valve or other members, which may be caused from long-time repetitive operations, such as separation and insertion of the valve from/into the dispensing hole in the cosmetic liquid dispenser.

Furthermore, since the dispensing space of the cosmetic liquid is formed by a gap in the outer periphery of the opening/closing valve upon the opening operation of the support, the smooth dispensation of the cosmetic liquid is impeded, thus being inconvenient to use.

As another example, a case for cosmetics has been disclosed in Korean Patent Laid-Open Publication No. 10-2006-74820, in which a dispenser coupled with an applicator is engaged with an upper portion of the case so as to be movable up and down, such that a pressing step on the outer periphery of the dispenser is assembled with and supported by an inner engaging ring of a cap so that the dispenser moves upward to open through separation of the cap from the case.

However, such a conventional case for cosmetics has a problem in that the support structure between the cap and the inner engaging ring of the support may be weakened upon long-term use, thus causing a malfunction in the operation of moving up the dispenser.

Further, there is a problem in that, if the dispenser returns down to its original position during use, the dispenser returns again to a closed state, so that it cannot supply the cosmetic liquid.

Furthermore, since, even when the dispenser is in an open state, the dispensing path of the cosmetic liquid, extending from a division hole to a dispensing hole via a guide path, is crooked, the smooth supply of the cosmetic liquid is difficult, so that additional force has to be applied to press the case, which is inconvenient.

SUMMARY OF THE INVENTION

Accordingly, the present invention has been made keeping in mind the above problems occurring in the related art, and the present invention is intended to propose a case for cosmetics, wherein, upon fastening up/down through rotation, an outer cap automatically opens/closes a dispensing hole of a cosmetic liquid dispenser to regulate the supply of cosmetic liquid to an applicator, thereby preventing unnecessary leakage of the cosmetic liquid and, even upon long-term use, preventing malfunction of the cosmetic liquid dispenser while simplifying the opening/closing structure of the dispensing hole, and providing a smooth supply of the cosmetic liquid by making a dispensing path linear to thereby maximize the reliability of use.

Another object of the present invention is to provide a case for cosmetics in which, even with a minimization in the number of parts and simplification of the assembly structure, opening/closing operations are reliably carried out, and the market quality is improved with a simplified assembly process and a minimized defective proportion.

In order to achieve the above objects, according to one aspect of the present invention, there is provided a case for cosmetics including a tubular case body containing the cosmetic liquid therein, a cosmetic liquid dispenser coupled to an upper portion of the case body and having a center cosmetic liquid dispensing hole and an upper engaging groove, an applicator engaged with the engaging groove of the cosmetic liquid dispenser, an outer cap screw-fastened to the case body in such a way as to include the cosmetic liquid dispenser and the applicator therein, an opening/closing valve provided below the cosmetic liquid dispensing hole in the cosmetic liquid dispenser and having a vertical discharging hole and an opening/closing hole horizontally passing through the discharging hole, and an opening/closing piece member horizontally inserted into the opening/closing hole in the valve while being resiliently supported by a compression spring such that an outer end thereof passes outside an assembling hole provided in the side face of the cosmetic liquid dispenser, whereby, upon screw-fastening of the outer cap, the opening/closing piece member horizontally moves forward to compress the compression spring to block the discharging hole, and whereby, upon screw-releasing of the outer cap, the opening/closing piece member is released from the compressed state to move back due to the restoring force of the compression spring to thereby open the discharging hole of the opening/closing valve.

The cosmetic liquid dispenser may be provided on its lower inner periphery with a ring type assembling protrusion, and the case body may be provided on its upper outer periphery with an assembling groove, into which the assembling protrusion is inserted, thereby providing a one-touch interference-fitting type structure.

The dispenser may be provided on the lower portion of the dispensing hole thereof with an assembling protrusion, and the opening/closing valve may be provided on the upper portion thereof with an assembling groove, thereby providing a relative press-fitting structure.

The opening/closing piece member may be provided, along the outer periphery of the outer end, with an annular engaging piece that is to be engaged with the inside of the assembling hole so as to prevent disconnection from the assembling hole of the dispenser.

The outer end of the opening/closing piece member, which is a head portion of the piece member, may be shaped like a semi-spherical round protrusion so as to minimize contact friction force with the outer cap upon screw-movement to thereby realize smooth movement.

The opening/closing piece member and the opening/closing valve may be respectively provided on the insides of the outer periphery with corresponding spring seating recesses for stable support of the compression spring therein.

According to the present invention, there is provided an effect of convenience in use in that the outer cap is fastened down onto the tubular case body so that the opening/closing feature resiliently and horizontally moves through the dispensing hole in the cosmetic liquid dispenser to close so as to reliably block the supply of the cosmetic liquid to the applicator to thereby prevent unnecessary leakage of the cosmetic liquid, and in that the opening of the dispensing hole of the cosmetic liquid dispenser is carried out by separation through screw-rotation of the outer cap so that the opening/closing feature returns to its original position to open by the resilient support by the compression spring to thereby prevent a malfunction.

Further, the path of the dispensing hole is provided in a linear form to, at the time of dispensing, prevent blockage of the cosmetic liquid, thereby advantageously reducing the strength of the grip required by a user.

Furthermore, simplified parts make it possible to minimize the manufacturing cost and defective proportion when manufacturing and prevent the occurrence of a malfunction even upon long-term use, thereby improving the reliability of a product.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF THE INVENTION

Figure 1:
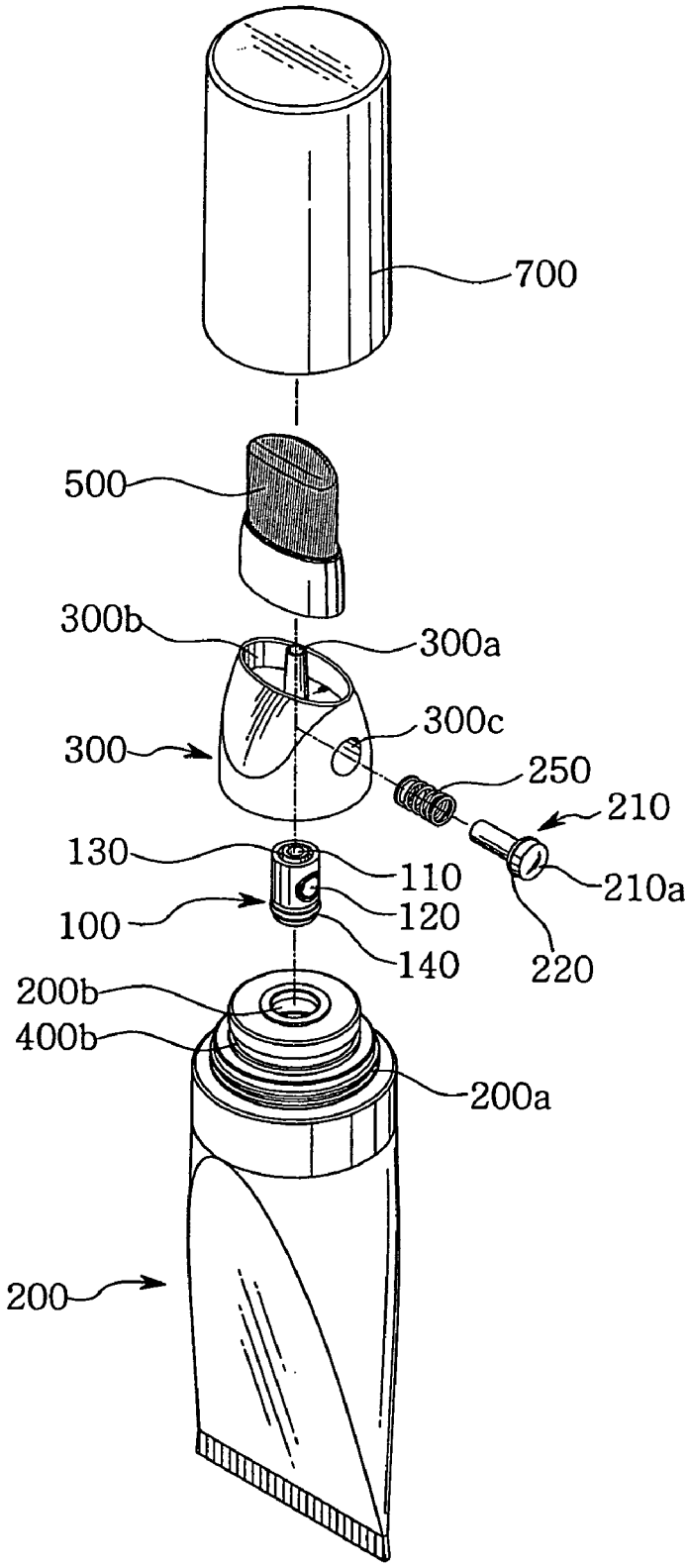
FIG. 1 is an exploded perspective view illustrating a case for cosmetics according to the present invention.
Figure 2:
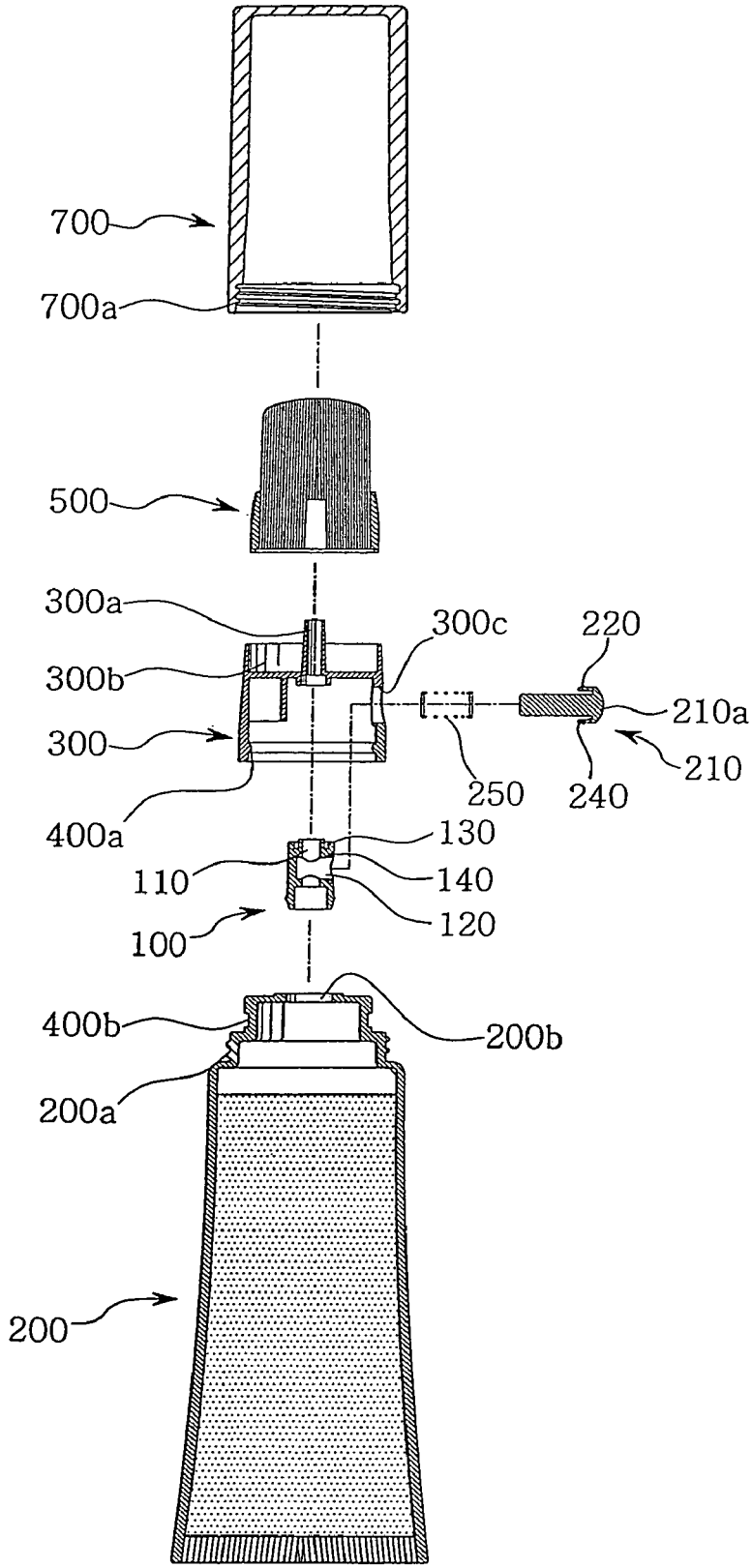
FIG. 2 is an exploded sectional perspective view illustrating the case for cosmetics according to the present invention.
Figure 3:
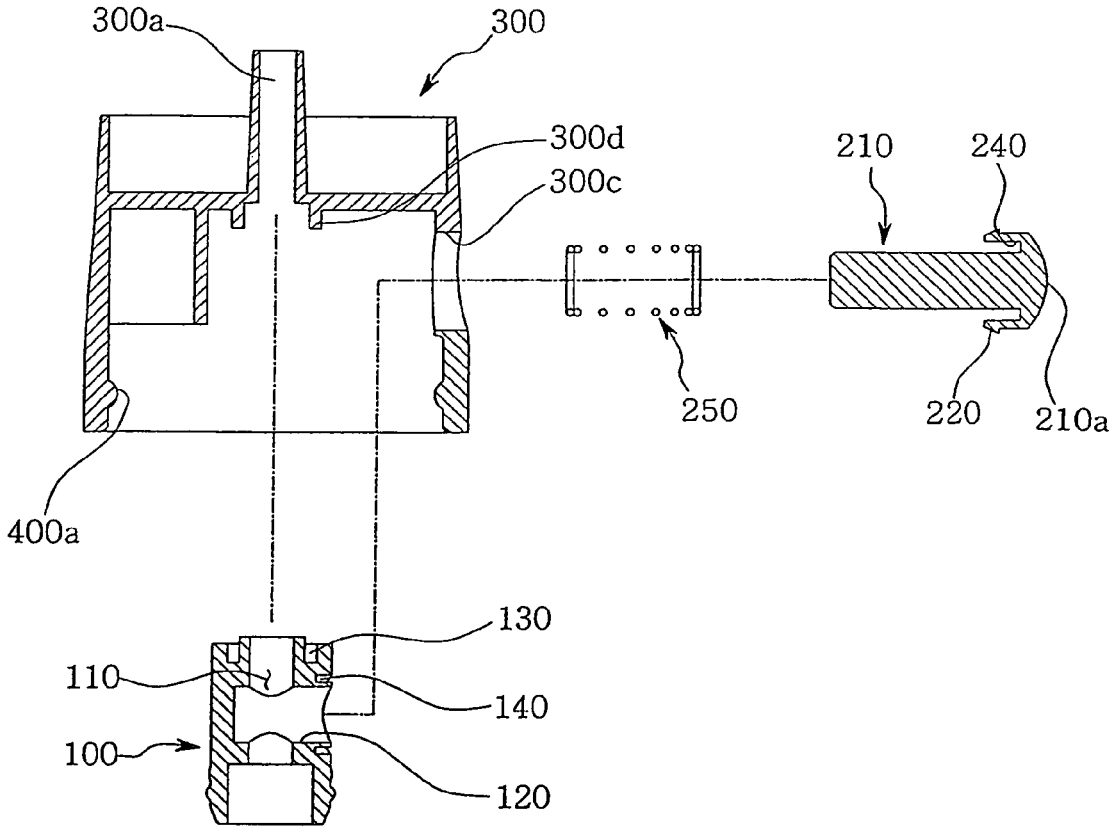
FIG. 3 is a partial enlarged view of FIG. 2.
Figure 4:
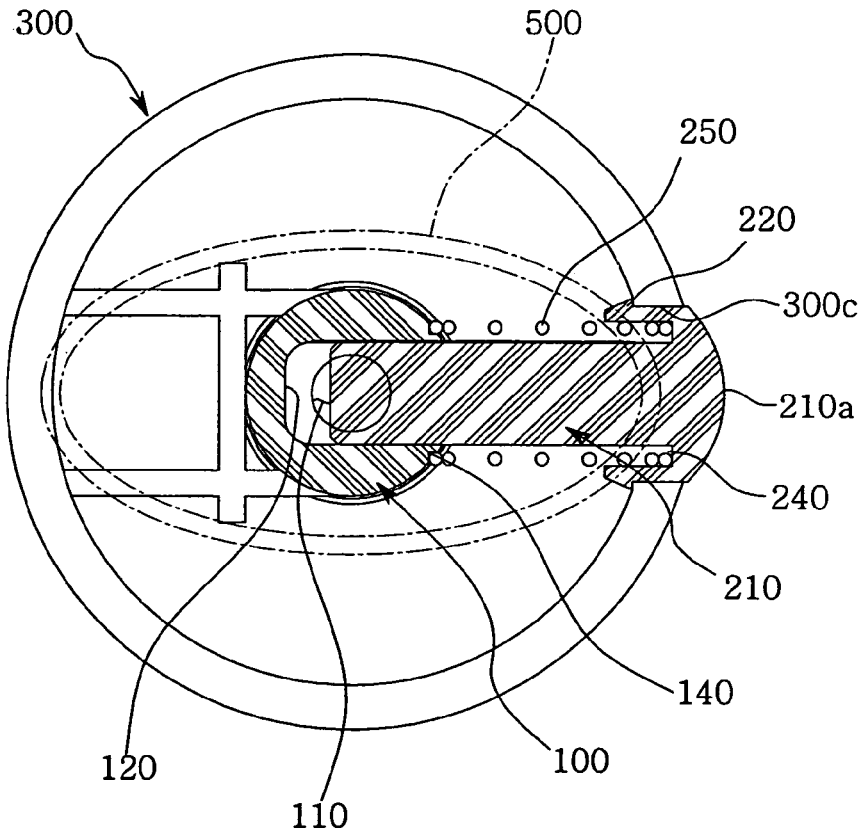
FIG. 4 is a front sectional view illustrating the case for cosmetics according to the present invention.
Figure 5:
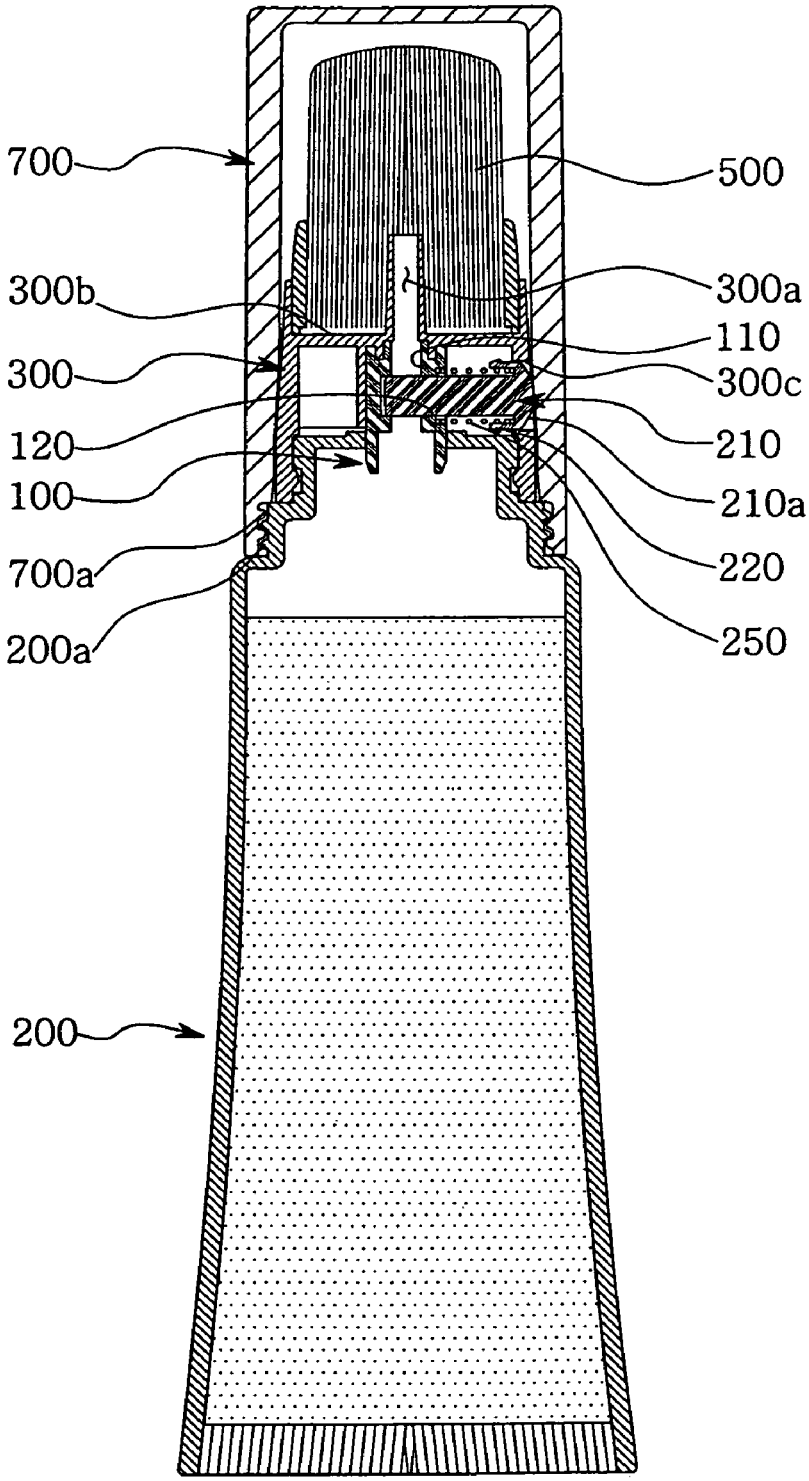
FIG. 5 is a side sectional view illustrating the case for cosmetics according to the present invention.
Figure 6:
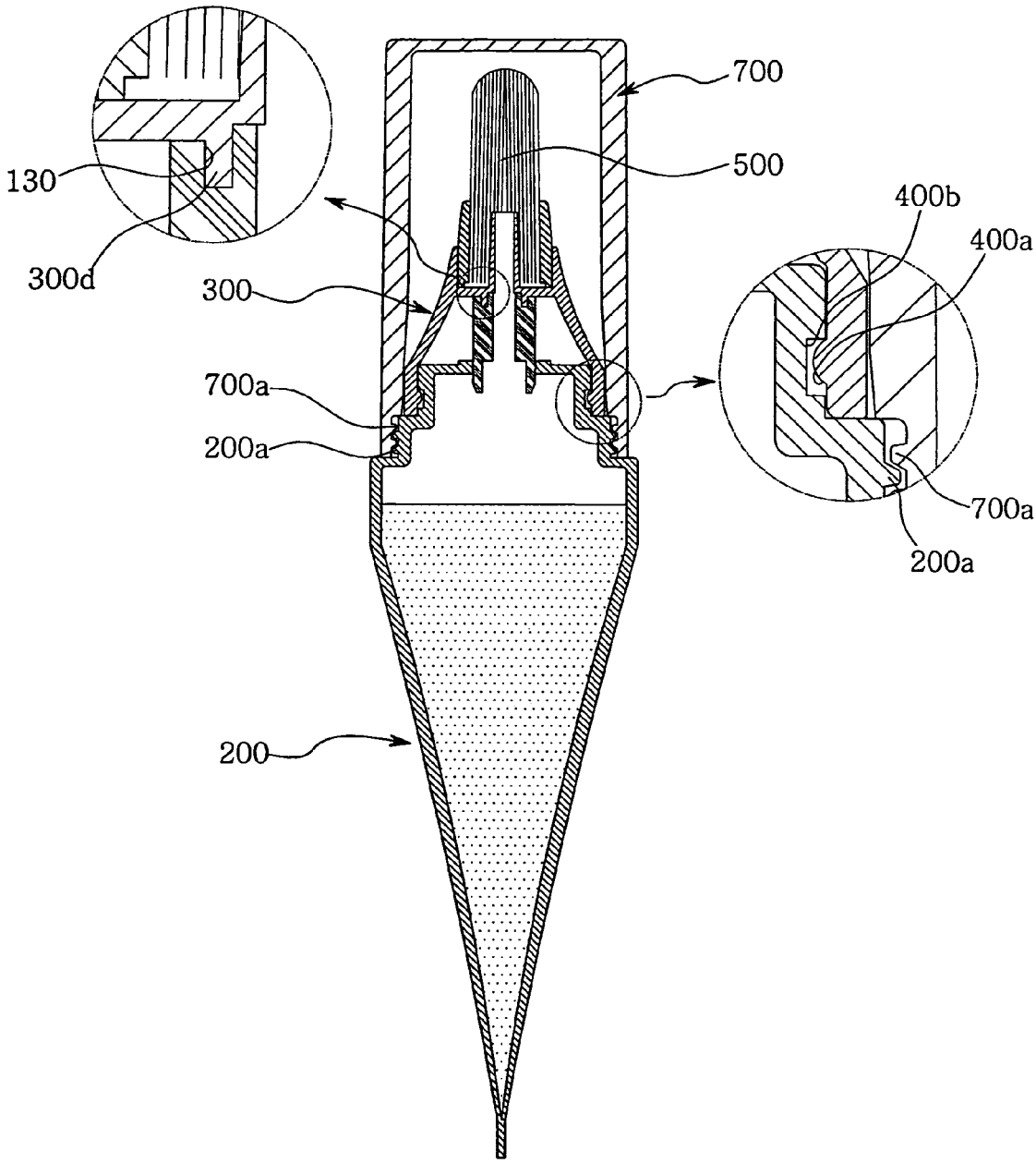
FIG. 6 is a plan sectional view illustrating the case for cosmetics according to the present invention.

Reference will now be made in greater detail to a preferred embodiment of the invention, an example of which is illustrated in the accompanying drawings. Wherever possible, the same reference numerals will be used throughout the drawings and the description to refer to the same or like parts.

The case for liquefied cosmetics according to the present invention is characterized in that a dispensing hole of a cosmetic liquid dispenser is opened/closed through a simple structure, by which the cosmetic liquid dispenser and an applicator are fastened onto and released from a case body through a screwing operation, to thereby regulate the supply of the cosmetic liquid to the applicator.

The case for cosmetics as shown in FIGS. 1 to 6 includes a tubular case body 200 containing the cosmetic liquid therein, a cosmetic liquid dispenser 300 coupled to an upper portion of the case body 200 and having a center cosmetic liquid dispensing hole 300*a* and an upper engaging groove 300*b*, an applicator 500 engaged with the engaging groove 300*b* in the cosmetic liquid dispenser 300, and an outer cap 700 screw-fastened to the case body 200 in such a way as to include the cosmetic liquid dispenser 300 and the applicator 500 therein, an opening/closing valve 100 provided below the cosmetic liquid dispensing hole 300*a* in the cosmetic liquid dispenser 300 and having a vertical discharging hole 110 and an opening/closing hole 120 horizontally passing through the discharging hole, and an opening/closing piece member 210 horizontally inserted into the opening/closing hole 120 in the valve while being resiliently supported by a compression spring 250 such that the outer end thereof passes outside an assembling hole 300*c* provided in the side face of the cosmetic liquid dispenser 300, whereby, upon screw-fastening the outer cap 700, the opening/closing piece member 210 horizontally moves forward to compress the compression spring 250 to block the discharging hole 110, and whereby, upon screw-releasing the outer cap 700, the opening/closing piece member 210 is released from the compressed state to move back due to the restoring force of the compression spring to thereby open the discharging hole 110 in the opening/closing valve 100.

The tubular case body 200 is made from a soft resinous material for implementing the pressing operation for discharging the cosmetic liquid, and may be of diverse shapes other than the one shown in the figures.

Further, the cosmetic liquid dispenser 300 has an upwardly-narrowing outer shape, in which an upper portion is narrow and a lower portion is wide, and the outer cap 700 covered around the dispenser has a corresponding shape so as to provide easy insertion.

The cosmetic liquid dispenser 300 is provided on its lower inner periphery with a ring type assembling protrusion 400*a*, and the case body 200 is provided on its upper outer periphery with an assembling groove 400*b*, into which the assembling protrusion is inserted, thereby providing a one-touch interference-fitting type structure.

In addition, the dispenser 300 is provided on the lower portion of the dispensing hole 300*a* thereof with an assembling protrusion 300*d*, and the opening/closing valve 100 is provided on the upper portion thereof with an assembling groove 130, thereby providing a relative press-fitting structure.

The outer end of the opening/closing piece member 210, i.e., a head portion of the piece member, is shaped like a semi-spherical round protrusion 210*a* so as to minimize the contact friction force with the outer cap 700 upon screw-movement to thereby realize smooth movement.

Further, the opening/closing piece member 210 is provided, along the outer periphery of the outer end, with an annular engaging piece 220 which is to be engaged with the inside of the assembling hole so as to prevent disconnection from the assembling hole 300*c* of the dispenser 300.

Meanwhile, the opening/closing piece member 210 and the opening/closing valve 100 are respectively provided on their insides of the outer periphery with corresponding spring seating recesses 240 and 140 for stable support of the compression spring 250 therein.

Reference numerals 200*a* and 200*b*, which have not yet been explained, denote a screw portion of the case body 200 which is screw-engaged with a screw portion 700*a* provided in an inner periphery of the outer cap 700, and an upper center through-hole of the case body 200, respectively.

Description will now be made of the operation and effect of the present invention, constructed as described above.

Describing first an assembling structure of the case for cosmetics, one end of the opening/closing piece member 210 is inserted into the opening/closing hole 120, which horizontally extends through the opening/closing valve 100 while being resiliently supported by the compression spring 250.

Here, both ends of the compression spring 250 are assembled in the spring seating recesses 140 and 240, each provided inside the opening/closing valve 100 and the opening/closing piece member 210.

Then, the opening/closing valve 100 is assembled below the dispensing hole 300*a* in the dispenser 200 such that the assembling protrusion 300*d* provided on the lower portion of the dispensing hole 300*a* is press-fitted into the corresponding assembling groove 130 provided in the upper portion of the opening/closing valve 100.

Then, the assembled dispenser 300 is press-fitted into the upper portion of the case body 200 so that the ring type assembling protrusion 400*a* provided on the lower inner periphery of the dispenser 300 is fitted into the assembling groove 400*b* provided in the upper outer periphery of the case body 200 in a one-touch type fitting manner.

Here, the upper engaging groove 300*b* in the dispenser 300 is coupled with an applicator 500, and finally the outer cap 700 is screw-fastened to the case body 200 such that it includes the dispenser 300 and the applicator 500 therein.

Now the operation of the case for cosmetics will be described.

Figure 7:
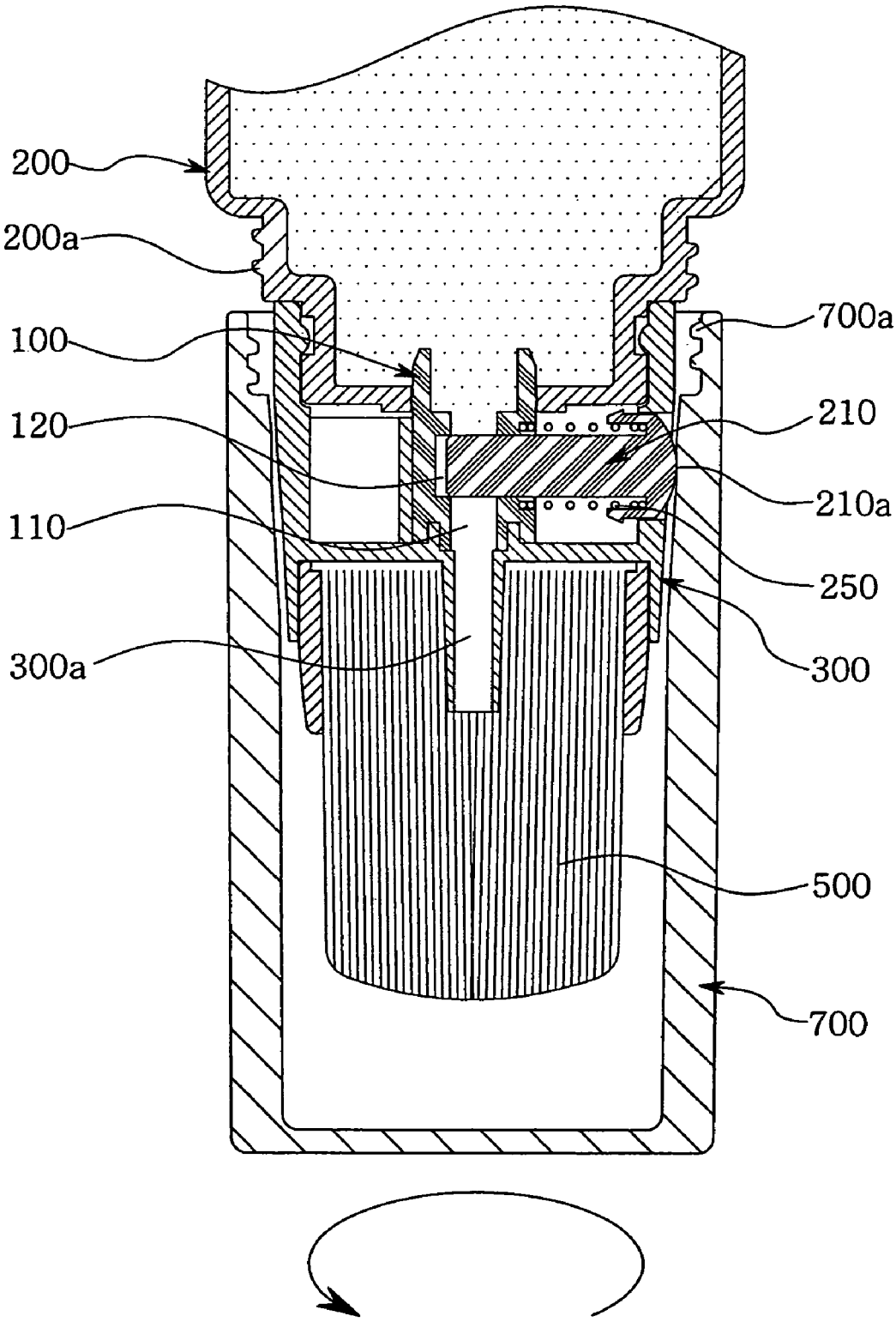
FIGS. 7 to 9 are views illustrating the operating states of the case for cosmetics according to the present invention.

If a user wants to use cosmetic liquid (liquefied cosmetics), as shown in FIG. 7, when he/she rotates and screw-releases the outer cap 700, which opens upward from the case body 200, the opening/closing piece member 210, which has been horizontally compressed inside the outer cap 700, comes released to move horizontally outside the assembling hole 300*c* in the dispenser 300 due to the resilient support by the compression spring 250.

Figure 8:
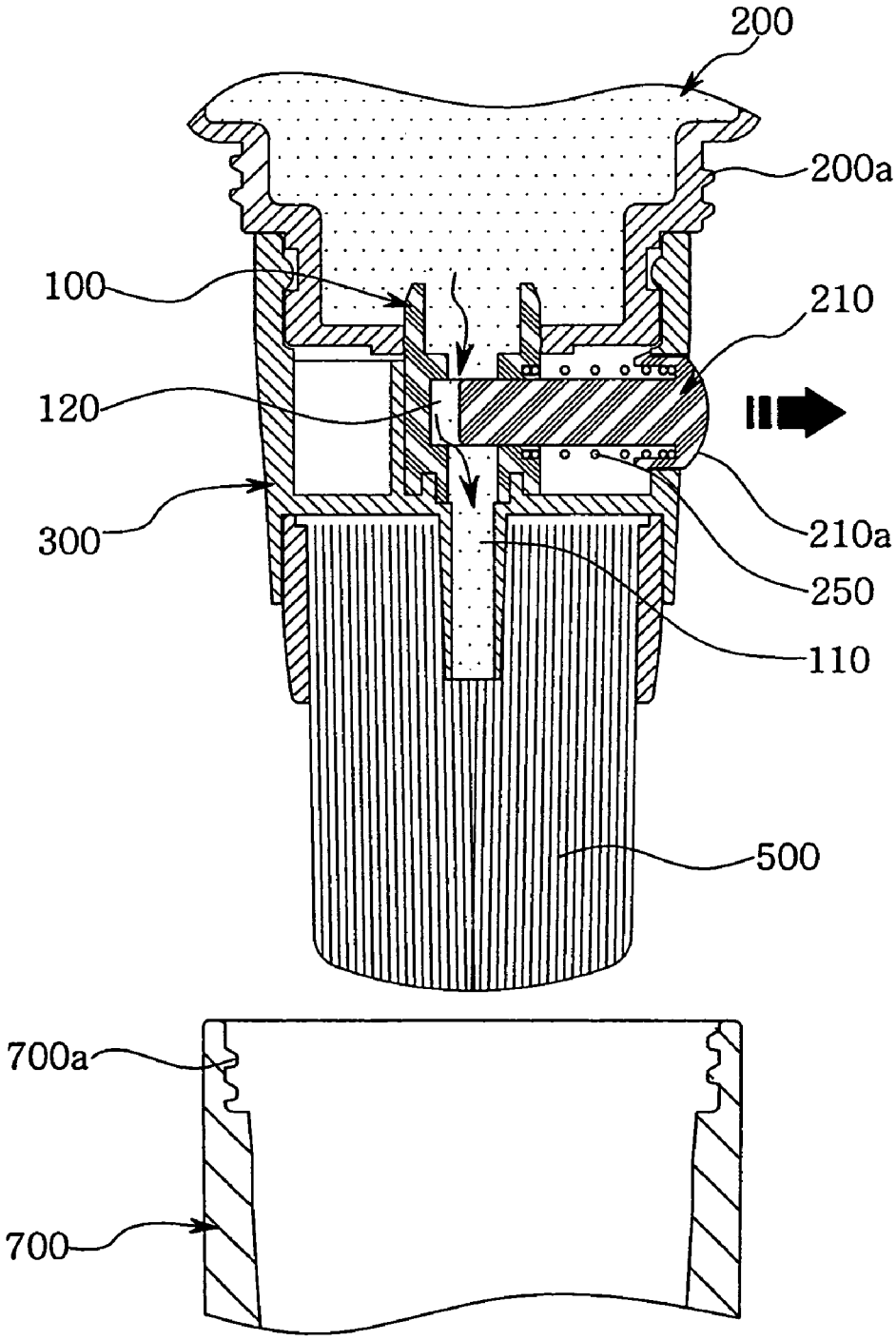

In that state, when the outer cap 700 is completely separated, as shown in FIG. 8, the opening/closing piece member 210 moves horizontally outside in the opening/closing hole 120 of the opening/closing valve 100 by the restoring force of the compression spring 250 to thereby open the discharging hole 110, which vertically extends from the opening/closing valve 100.

Herein, since the engaging piece 220 formed along the outer periphery is engaged with the inside of the assembling hole 300*c* of the dispenser 300, the opening/closing piece member 210 is prevented from being separated due to the limitation of resilient movement to a predetermined distance.

When the discharging hole 110 is opened in this way, a user presses the case body 200 to supply the cosmetic liquid to the applicator 500 via the discharging hole 110 in the valve 100 and the dispensing hole 300*a* in the dispenser.

Particularly, since the discharging path of the cosmetic liquid is made vertically linear and the discharging hole 100 is opened/closed substantially completely, the supply of the cosmetic liquid is smoothly carried out.

When the cosmetic liquid is supplied to the applicator in this way, a user is able to apply the cosmetic to his/her face using the applicator.

Figure 9:
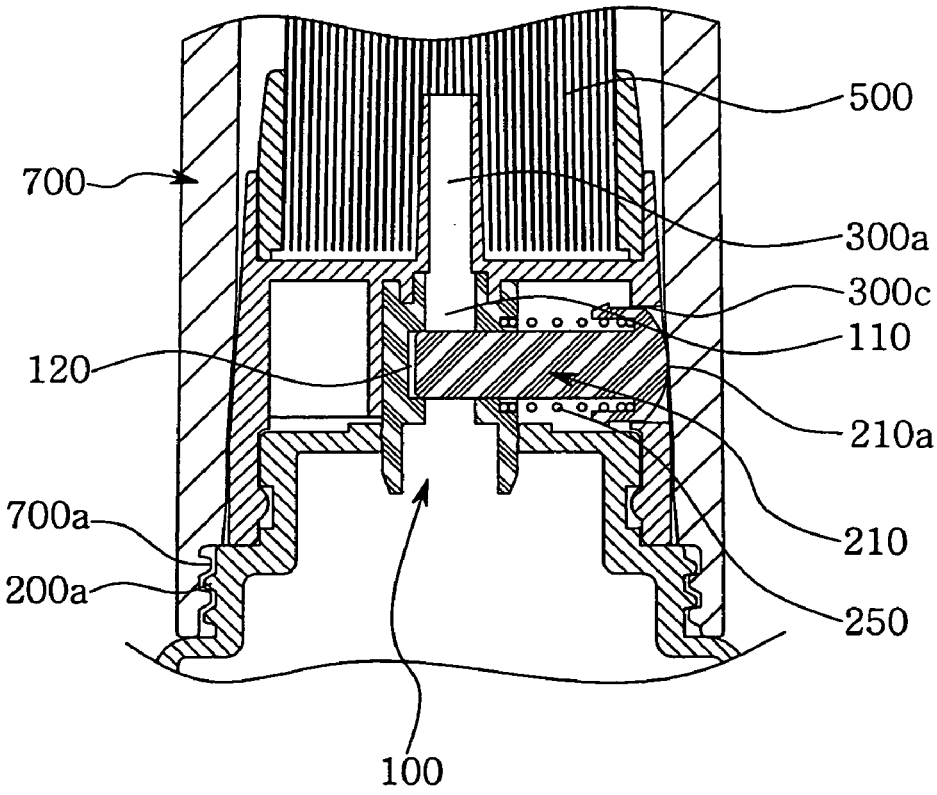

After the use, as shown in FIG. 9, the user screw-fastens the outer cap 700 to the case body 200 to close it.

Here, the dispenser 300 and the outer cap 700 have corresponding upwardly-narrowing shapes, so that initial insertion can be easily carried out in a one-touch manner.

When the outer cap 700 is fitted in a one-touch manner as such, the opening/closing piece member 210, which has protruded horizontally outside the dispenser 300 by the resilient force of the compression spring 250, is forced toward the lower inner periphery of the outer cap 700 to compress the compression spring 250, and moves the opening/closing valve 100 forward, thereby blocking the discharging hole 110.

Particularly, since the outer end of the piece member 210 is a semi-spherical round protrusion 210*a*, upon one-touch fitting of the outer cap 700, it horizontally moves forward smoothly without friction against the inner periphery of the cap to thereby minimize the vertical load applied thereto.

In this one-touch fitting state of the outer cap 700, when screw-fastening is carried out to provide a complete locking state, the piece member 210 fixes the forwarded state in the opening/closing hole 120 of the valve 100 to completely block the vertical discharging hole 110 in the valve 100, so that, even when the case body 200 is pressed by external force, the supply of the cosmetic liquid is blocked to thus secure the stability thereof.

What is claimed is:

1. A case for cosmetics, comprising:

a tubular case body containing the cosmetic liquid therein;

a cosmetic liquid dispenser coupled to an upper portion of the case body and having a center cosmetic liquid dispensing hole and an upper engaging groove;

an applicator engaged with the engaging groove in the cosmetic liquid dispenser;

an outer cap screw-fastened to the case body in such a way as to include the cosmetic liquid dispenser and the applicator therein;

an opening/closing valve provided below the cosmetic liquid dispensing hole in the cosmetic liquid dispenser and having a vertical discharging hole and an opening/closing hole horizontally passing through the discharging hole; and an opening/closing piece member horizontally inserted into the opening/closing hole of the valve while being resiliently supported by a compression spring such that an outer end thereof passes outside an assembling hole provided in a side face of the cosmetic liquid dispenser, wherein, upon screw-fastening the outer cap, the opening/closing piece member horizontally moves forward to compress the compression spring to block the discharging hole, and wherein, upon screw-releasing the outer cap, the opening/closing piece member is released from the compressed state to move back due to restoring force of the compression spring to thereby open the discharging hole in the opening/closing valve.

2. The case for cosmetics as set forth in claim 1, wherein the cosmetic liquid dispenser is provided on its lower inner periphery with a ring type assembling protrusion, and the case body is provided on its upper outer periphery with an assembling groove, into which the assembling protrusion is inserted, thereby providing a one-touch interference-fitting type structure.

3. The case for cosmetics as set forth in claim 1, wherein the dispenser is provided on a lower portion of the dispensing hole thereof with an assembling protrusion, and the opening/closing valve is provided on an upper portion thereof with an assembling groove, thereby providing a relative press-fitting structure.

4. The case for cosmetics as set forth in claim 1, wherein the opening/closing piece member is provided, along the outer periphery of the outer end, with an annular engaging piece that is to be engaged with the inside of the assembling hole so as to prevent disconnection from the assembling hole of the dispenser.

5. The case for cosmetics as set forth in claim 4, wherein the outer end of the opening/closing piece member, which is a head portion of the piece member, is shaped like a semi-spherical round protrusion so as to minimize contact friction force with the outer cap upon screw-movement to thereby provide smooth movement.

6. The case for cosmetics as set forth in claim 1, wherein the outer end of the opening/closing piece member, which is a head portion of the piece member, is shaped like a semi-spherical round protrusion so as to minimize contact friction force with the outer cap upon screw-movement to thereby provide smooth movement.

7. The case for cosmetics as set forth in claim 1, wherein the opening/closing piece member and the opening/closing valve are respectively provided on their insides of the outer periphery with corresponding spring seating recesses for stable support therein of the compression spring.

* * * * *